United States Patent [19]

Ingersoll

[11] Patent Number: 4,632,474

[45] Date of Patent: Dec. 30, 1986

[54] JEWELRY STORAGE DEVICE

[76] Inventor: Evelyn Ingersoll, 1200 S. 7th West, Salt Lake City, Utah 84104

[21] Appl. No.: 681,670

[22] Filed: Dec. 14, 1984

[51] Int. Cl.[4] ..... A47B 49/00; A47F 3/10

[52] U.S. Cl. ..... 312/305; 312/125; 312/135; 312/252

[58] Field of Search ..... 312/305, 125, 135, 252, 312/209

[56] References Cited

U.S. PATENT DOCUMENTS

| | | | |
|---|---|---|---|
| 353,419 | 11/1886 | Lamson | 312/135 |
| 456,728 | 7/1891 | Lamson | 312/305 |
| 483,469 | 9/1892 | Mosser | 312/135 |
| 492,304 | 2/1893 | Markle | 312/135 |
| 614,479 | 11/1898 | Klein | 312/305 |
| 645,040 | 3/1900 | Mayo | 312/305 |
| 799,233 | 9/1905 | Hubbell . | |
| 819,432 | 5/1906 | Jaeger | 312/125 |
| 1,134,908 | 4/1915 | Romsos | 312/135 |
| 1,687,149 | 10/1928 | Shauer et al. | 312/305 |
| 1,736,007 | 11/1929 | Johnston | 312/305 |
| 1,791,736 | 2/1931 | McCosh . | |
| 2,030,780 | 2/1936 | Bicknell | 312/125 |
| 2,166,633 | 7/1939 | Hardy | 312/305 |
| 2,390,657 | 12/1945 | Loudermilk | 312/125 |
| 2,488,641 | 11/1949 | Seawright | 312/135 |
| 2,624,911 | 1/1953 | Brown | 312/305 |
| 2,965,429 | 12/1960 | Stanger . | |
| 3,164,431 | 1/1965 | Black . | |
| 3,197,096 | 7/1965 | Marococchio . | |
| 3,851,940 | 12/1974 | Relyea et al. | 312/209 |
| 3,880,484 | 4/1975 | Sicina | 312/125 |
| 3,997,050 | 12/1976 | Patterson . | |
| 4,030,608 | 6/1977 | Howard . | |
| 4,058,356 | 11/1977 | Michal . | |
| 4,240,684 | 12/1980 | Henning | 312/125 |
| 4,261,461 | 4/1981 | Kizlauskas . | |

*Primary Examiner*—Victor N. Sakran

*Attorney, Agent, or Firm*—Trask, Britt & Rossa

[57] ABSTRACT

A storage device is particularly suitable for storing jewelry items. It has a base with a shaft extending upward therefrom with a plurality of spaced-apart shelves. A portion of the surface of each shelf is formed of a mesh which presents apertures to receive the posts of, for example, post-type pierced earings. The shelves are surrounded by a cylindrical-like housing, a portion of which is rotatable about the other to provide for access. Dish-like recesses are formed in the base for storage of, for example, fasteners for post-type pierced earings. The top shelf has spaced-apart posts along its perimeter from which articles such as necklaces may be suspended. The top shelf also has slots formed therein to receive articles such as the base or finger portion of rings.

13 Claims, 8 Drawing Figures

JEWELRY STORAGE DEVICE

BACKGROUND OF THE INVENTION

1. Field

This invention relates to personal article storage devices, and more particularly to apparatus for storing jewelry.

2. State of the Art

Recently, earrings for use with pierced ears (pierced earrings) have become increasingly common. These earrings come in a wide assortment of shapes and sizes and they typically come in matched pairs. One common form (post-type) is typically small with each earring having a single post which extends substantially normal to the decorative earring structure. The post is sized in length so that it may be positioned through an opening formed in the earlobe of a user (pierced ear) and held in position by a fastener which secures to the post portion extending behind the earlobe. A small cultured pearl affixed to a gold (metallic) setting with a post extending therefrom is but one example of a post-type pierced earring in widespread use today.

Some earrings for pierced ears have elongated decorative structure suspended below a generally "U"-shaped suspension member which is threaded through the opening of a pierced ear. Yet other types are formed with a post or pin-like structure for passing through the opening in the ear with the decorative structure passing about the earlobe to fasten to the post therebehind to give the illusion of a ring being suspended from the earlobe.

A variety of jewelry boxes or devices for storing articles of jewelry, such as rings, pendants, earrings, necklaces and the like, have long been in use and are well known. In one form of jewelry storage device shown in U.S. Pat. No. 3,997,050 (Patterson), a tray is used to store items such as rings, and a cloth-covered cylinder is used to retain pins or brooches. Hooks are placed near the top of the cylinder for storing necklaces. In yet another form shown in U.S. Pat. No. 4,058,356 (Michael), a container is used to store items, and arms extend from a shaft for storing necklaces. Hooks on the doors of a housing are for rings, watches and the like.

Other forms of jewelry boxes available today have various shallow compartments or drawers for storing items including pierced earrings. When a number of pairs of pierced earrings are placed in such a compartment by themselves or together with other jewelry items, it becomes somewhat difficult to quickly and easily retrieve a particular earring or matched pair of pierced earrings. For example, when an assortment of jewelry items are stored in the tray of Patterson, it can be seen that recovery of one or a pair of pierced earrings of the post-type from the tray shown in U.S. Pat. No. 3,997,050 (Patterson) would typically involve some amount of searching. This is particularly the case for the relatively small post-type pierced earrings and their associated fasteners which may become disassociated from the actual pierced earrings to which they belong. The user must search through a jewelry box to identify first the appropriate pair of earrings desired to be worn, and thereafter search to identify acceptable fasteners for holding them or securing them to the ear.

Similarly, rings and necklaces may be placed in known jewelry boxes by placing them in selected compartments as desired by the user. However, when such items become intermixed, it becomes difficult to remove them and/or to easily and readily identify the desired chain and/or ring.

An improved jewelry box or storage apparatus is thus desirable to facilitate easier storage of pierced earrings especially of the post type, as well as other items of personal jewelry in common use such as chains, particulary the simple gold chains that are presently in widespread use, and rings, all of which may be generally referred to as costume jewelry. Costume jewelry also includes, of course, many types of colored beads and a variety of other different pins, pendants and the like. Those items may also be stored in jewelry boxes in an organized fashion as desired.

SUMMARY OF THE INVENTION

A personal article storage apparatus has a base, a shaft and at least one shelf. The shaft extends upwardly from the base. The shelf is mounted on the shaft in spaced relation therealong. At least one of the shelves has a mesh as a substantial portion of its surface area. The mesh presents a plurality of apertures sized to recieve a pin-like post of an article to be stored. The lattice members of the mesh support the article. A plurality of shelves may be placed along the shaft in spaced apart relation and are preferably sized in surface area and spaced along said shaft so that the fingers of the user can place and remove articles anywhere on the surface of a shelf.

In one embodiment, the shelves may be fixedly secured to the shaft, which is rotatably mounted to the base. Alternately, the shelves may be rotatably mounted to the shaft.

The base preferably has formed therein at least one recess which is desirably shallow and dish-like to receive and store articles.

The shelves are preferably surrounded or enclosed by housing structure, which includes a first housing member secured to the base, and a second housing member which may be secured either to the base or to the first housing member so as to provide a means for access to said shelves. The housing members are preferably formed each to be semicircular-like in cross-section to form together a cylinder-like structure with one housing member slidably mounted to the base and sized to snugly and slidably move around the other housing member.

In another embodiment, the bottom shelf is spaced from the base to provide access to said recess. The other shelves which rotate about the shaft have less surface area than the bottom shelf and have a portion of their perimeter substantially similar in projection and dimension to the perimeter of said bottom shelf.

In another embodiment, the top shelf of the plurality of shelves has a number of spaced posts positioned about its perimeter from which articles such as chains, necklaces and elongated pierced earrings having "U"-shaped suspension members may be suspended. The top shelf, or alternately any shelf, may have formed therein a slot or plurality of slots to receive the ring portion of rings or appropriate structure of other jewelry items.

BRIEF DESCRIPTION OF THE DRAWINGS

In the drawings, which illustrate the best mode presently contemplated for carrying out the invention.

DESCRIPTION OF THE ILLUSTRATED EMBODIMENTS

Figure 1:
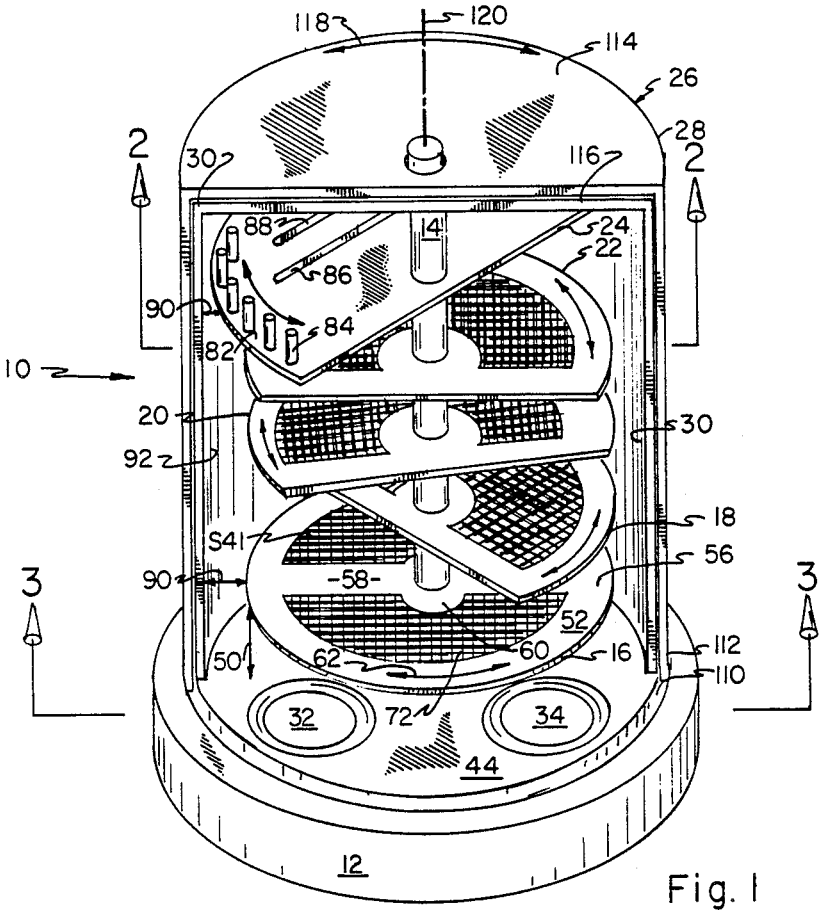
FIG. 1 is a frontal perspective view of a preferred embodiment of the instant invention.

FIG. 1 shows a personal article carousel 10 having a base 12 with a shaft 14 extending upwardly therefrom. A plurality of shelves, which is here shown to be five (5) shelves 16, 18, 20, 22 and 24, are mounted to the shaft 14 in spaced relation therealong as shown.

The shelves 16, 18, 20, 22 and 24 are surrounded by a housing structure which is generally indicated by the number 26 and which, as here shown, is comprised of a first housing member 28 and a second housing member 30, each of which is substantially semicircular in cross-section, and which together form a cylinderlike housing structure as more fully discussed hereinafter.

Figure 2:
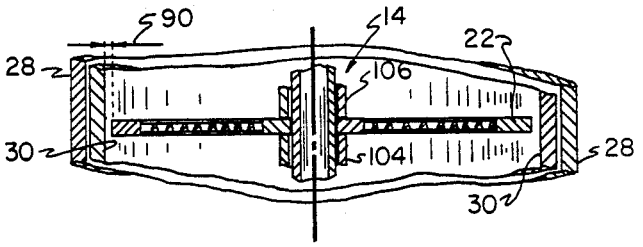
FIG. 2 is a cross-section taken at the section lines 2—2 of the preferred embodiment shown in FIG. 1.
Figure 3:
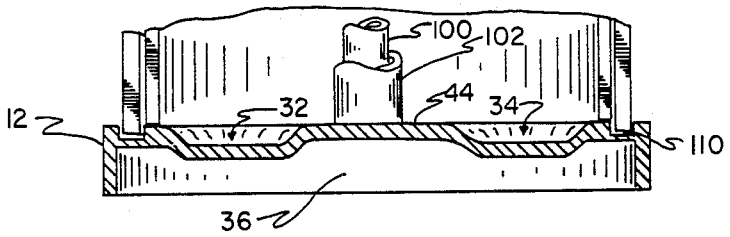
FIG. 3 is a cross-section taken at the section lines 3—3 of the preferred embodiment shown in FIG. 1.
Figure 7:
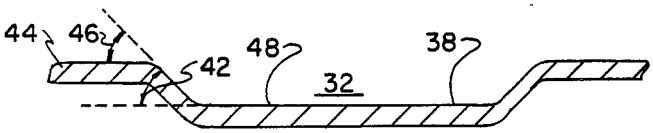
FIG. 7 is an enlarged partial cross-section of a recess formed in the base of the invention shown in FIG. 1.

Referring now more particularly to FIGS. 1, 2 and 3, it can be seen that the base 12 is formed out of any convenient material such as plastic to be substantially circular with a hollowed-out portion 36. Two shallow dish-like recesses 32 and 34 are formed in the base 12 as best shown in FIGS. 3 and 7. The floor 38 of recess 32 is formed to have a relatively small or shallow angle 40 with the sidewall 42 of the recess 32. Further, the angle 46 formed by the sidewall 42 and top surface 44 of the base 12 is also substantially small. It may be also noted from FIG. 7, as well as from FIG. 3, that the surface 48 of the recess 32 is smooth, with the intersection between the floor 38 and the sidewall 42 and between the top surface 44 of the base 12 and the sidewall 42 being arcuate or rounded. Thus, items such as the fasteners for post-type pierced earrings may be positioned within the recess 32 and easily removed therefrom with the fingertip by rolling them or urging them slidably along its surface 48 onto the surface 44 where they may be easily grasped.

It can be seen from FIG. 1 that the recesses 32 and 34 are generally circular in configuration further to avoid the presence of an edge or lip which would make removal of the clips more difficult as the clip or other article would become trapped against an edge. It should be appreciated, however, that the recesses 32 and 34 need not be circular in configuration. They may be any other shape so long as at least one edge thereof, preferably the edge closest to the user is rounded substantially as shown in FIG. 7 to facilitate the sliding and/or rolling removal of items therein positioned. Even though there are two substantially identical recesses 32, 34 here shown, it should be understood that one or two or even more recesses may be formed in the base 12 as desired.

The bottom shelf 16 is desirably positioned at a height 50 (FIG. 1) above the top surface 44 of the base 12 so that easy finger access may be had to the recesses 32 and 34 for removal of items positioned therein or thereon.

Referring again to FIG. 1, it can be seen that the bottom shelf 16 is substantially circular in projection and is formed to have a substantial portion of its surface 52 formed of a mesh 54 or grid which is here depicted by the use of closely proximate intersecting lines. Each of the lines as depicted represents the interconnecting latticework of mesh 54 which form a plurality of apertures which are sized to receive the post of an article such as the post of a post-type pierced earring. The mesh 54 is preferably formed of a substantially rigid material (e.g., plastic) to provide the shelf with the strength to hold other articles placed therein.

As shown in FIG. 1, the bottom shelf 16 has an outer rim 56 and an interconnecting portion 58 which are formed of a solid material in order to provide the shelf with additional structural stability and rigidity. Similarly, the portion 60 of the shelf proximate the shaft 14 is also made of solid material to facilitate mounting thereto. It should further be noted that shelf 16 as here shown is mounted to rotate 62 about the shaft 14 in a manner as more fully discussed and described with respect to shelf 22 hereinafter.

Figure 5:
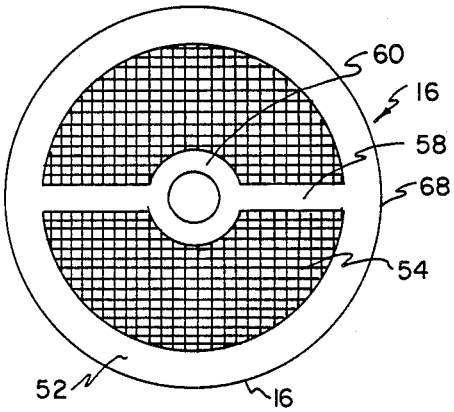
FIG. 5 is a plan view of a shelf of the type shown in FIG. 4.
Figure 6:
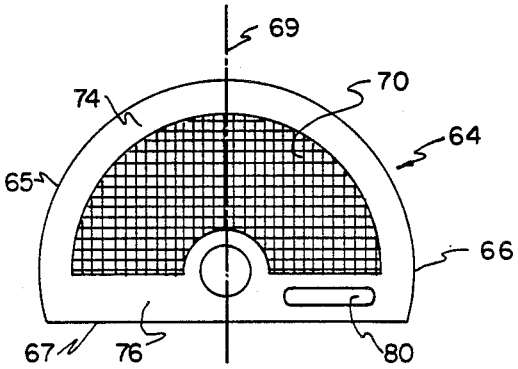
FIG. 6 is a plan view of a shelf of the type shown in the preferred embodiment of FIG. 1.

The shelves 18, 20 and 22 shown in FIG. 1 are formed similar to shelf 64 shown in FIG. 6. It can be seen that shelf 64 has less surface area than the bottom shelf 16. A portion 65 of the perimeter 66 of the shelf 64 is substantially circular in projection and similar in projection and dimension to that of the bottom shelf 16 which shown in FIG. 5. The remaining portion 67 of the perimeter 66 is formed along a chord line which is substantially normal to a line 69 which bisects the circular portion 65 of the perimeter as shown. That is, the shelf 64 of FIG. 6 is, in effect, truncated or more closely described as substantially semicircular (in projection).

The shelves 18, 20, 22 and 24 shown in FIG. 1 are mounted to be rotatable around the shaft 14 and are so formed so that upon rotation the mesh surface area 54, 70, 72 of the shelf below it will be exposed for viewing and access by the user. That is, the shelves 18, 20, 22 and 24 are shaped so that one can be rotated with respect to the other to provide easy access to the entire surface area of the shelf below it and for easy viewing of the items therein stored. It may be noted that the truncated or substantially semicircular (in projection) shape shown in FIGS. 1 and 6 for shelves above the bottom shelf is presently preferred. However, other shapes or forms may be selected to accomodate a particular housing structure. In the absence of housing structure, the shape or form may be selected as desired so long as access is facilitated.

As shown in FIG. 1, shelf 18 has been rotated to expose the surface area 72 to easy viewing and easy access by the user. By forming the shelves above the bottom shelf to be, in effect, semicircles, as shown in FIG. 6, a greater number of shelves may be positioned along the length of the shaft 14 to increase the storage capacity of the personal article carousel 10 for a given length of a shaft.

With respect to shelf 64 shown in FIG. 6, it can be seen that it has a mesh portion 70 substantially similar to the mesh portion 54 of the bottom shelf 16. It can also be seen that it has an outer portion 74 formed of a solid material (e.g., plastic) to provide strength. The chord portion 76 is similarly formed of a solid material (e.g., plastic) to provide for strength and also to provide for the aperture 78 for mounting the shelf rotatably to the shaft 14. The shelf 64 shown in FIG. 6 also has formed in the support section 76 an elongated slot 80 which may be used for positioning rings or other articles of jewelry. That is, any shelf, including the bottom shelf 16, may have a slot formed in the solid portions thereof as well as in the mesh, if structurally rigid mesh is used, to receive rings or similar articles that have an elongated portion which would extend through the slot, the sides of the slot supporting the decorative structure of the items.

Referring back to FIG. 1, it can be seen that a top shelf 24 is here shown as formed of substantially solid material (e.g., plastic) and rotatably mounted for rotation about the shaft 14. Along the outer edge 82 of the top shelf 24 is a plurality of posts 84 from which chains, necklaces or earrings with elongated decorative structure may be suspended. Also, rings or other small round-like jewelry items may be placed about the posts. Elongated slots 86 and 88 are also formed in the shelf 24 for receiving rings or other similar types of jewelry items for storage purposes. It should be noted that the shelves 16, 18, 20, 22 and 24 are spaced a sufficient distance 90 from the inner wall 92 of the housing structure 26 to provide space for suspending chains and necklaces or similar jewelry items from the posts 84 of the top shelf 24. Similarly, the top shelf 24 may be made slightly larger in projection if desired to ensure that suspended articles do not interfere with the operation of the lower shelves.

As shown in FIG. 2, the shelf 22 is mounted to rotate about the shaft 14. The shaft 14 is shown to be comprised of a first or inner shaft 100 (FIG. 3) positioned snugly and rotatably within another hollow shaft 102. The hollow member 102 is first positioned on the top surface 44 of the base 12. A shelf member, such as 16, is positioned rotatably but snugly about the inner shaft 100 and is in turn supported by the outer shaft 102. Another piece of hollow shaft is then positioned above the shelf 16 which in turn acts as the support and rotating bearing for the shelf therebove, 18. As shown in FIG. 2, in cross-section a hollow shaft section 104 is supported by the shelf below 20 (not shown) to provide a bearing surface and support for shelf 22. Another section of hollow shaft 106 is positioned thereabove to provide support for shelf 24 thereabove. In this fashion, each of the shelves can rotate independently about the inner shaft 100. It can be appreciated that a variety of other techniques or means may by utilized to provide for independently rotatable shelves about a central shaft 14. For example, grooves may be formed in a solid shaft 100 into which the shelves are forced or formed in order to be rotatable.

Referring again to FIG. 1, the housing 26 is here shown to be a cylindrical-like structure having a first housing section 28 and a second housing section 30. As shown in FIG. 1, the housing section 30 is secured to the base 12. The first housing member 28 is positioned in a circular track 110 formed in the base 12 and into which the bottom 112 of the first housing member 28 is placed. It should be noted that the first 28 and second 30 housing members are both substantially semicircular in crosssection and have each a top section 114 and 116, respectively, so that as the first housing section 28 is rotated 118 about the axis 120, the interior of the carousel structure 10 will be closed. That is, the outer or first housing member 28 and second housing member 30 are each formed so that from the top they have a projection or shape similar to the shelf 64 in FIG. 6. Thus, there is some overlap between the inner or second housing member 30 and outer or second housing member 28 to provide for closure of the interior of the structure.

It can be appreciated that the rotatable housing member could well be the inner member 30 and the fixed member could be the outer member 28. It should also be understood that openable doors could be fixed to the secured member, such as member 30, to provide for access to the interior of the carousel 10.

It may also be noted that the shaft 14 shown in FIG. 1 is extending through the tops 114 and 116 of the first and second housing members. It should be understood that the shaft 14 need not so extend, but is preferably shown to so extend in order to provide a central axle for rotating the first housing member 28. It may be noted that the first and second housing members are, in effect, truncated cylinders, each having a top which, in effect, is semicircular in appearance. When the first housing member 28 is rotated from its fully open (shown) position to its fully closed position which is 180° about the effective centerline 120 of the cylinder, the result is an enclosing cylinder or housing structure openable as desired to provide access.

Figure 4:
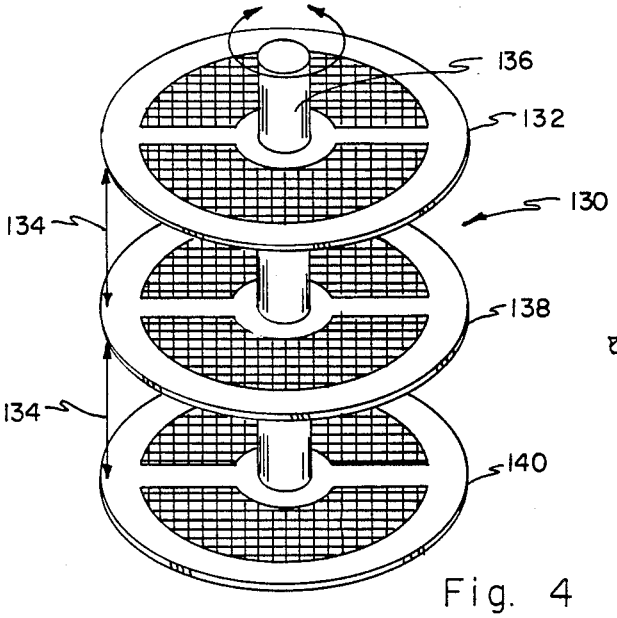
FIG. 4 shows an alternate shelf structure for use in the apparatus of the instant invention.

FIG. 4 shows an alternate shelf arrangement 130 which is comprised of a plurality of shelves substantially similar to the shelves 132, 138, 140 shown and described in FIG. 5. Additionally, each of the shelves 132, 138, 140 shown in FIG. 4 may have slots similar to slot 80 (FIG. 6), formed in the solid portions thereof. Also, posts may be formed or positioned along the outer edge of the upper shelf 132 similar to the posts 84 shown in FIG. 1 in association with top shelf 24.

The shelf arrangement 130 shown in FIG. 4 has shelves which are spaced apart by a distance 134 sufficient to permit access of the fingers proximate the shaft 136 to which the shelves 132 and 138 are mounted. The distance 134 is, in effect, selected to provide for access to the shelf portion proximate the shaft 136 and therefore, in turn, is selected based on the diameter or radius of each of the shelves 132, 138 and 140. Similarly, the upper or top shelf 132 is spaced from the top part 116 and 114 of the housing structure 26 to similarly provide access to the interior portion of the shelf proximate the shaft 136. In the arrangement 130 shown in FIG. 4, shelves are fixedly secured to the shaft 136 which is in turn rotatably mounted to a base, such as base 12, by providing for a bearing recess therein. The upper end of the shaft 136 fits within a bearing recess formed in the top of the housing structure 26.

Figure 8:
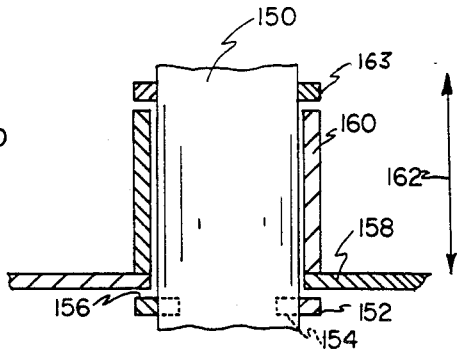
FIG. 8 is a partial cross-sectional view of an alternate and preferred shelf and shaft structure of the instant invention.

FIG. 8 illustrates another and preferred alternative means for rotatably mounting the shelves to a shaft. A crosssectional portion of the shaft 150 has a ring 152 such as a snap ring, split ring or locking ring fitted thereabout. The ring 152 may be squeezed or sweated about the shaft 150 or may fit into a slot 154 formed in the shaft 150. The ring 152 is formed to have a flat upper bearing surface 156 and is sized to extend outwardly from the shaft 150, a distance sufficient to provide support for the shelf 158 positioned thereabove. The shelf 158 is shown spaced away from the ring 152 only for purposes of illustration. The shelf 158 in use will be in rotatable contact with the flat surface 156 which acts as a support and bearing surface. Only a shortened portion of the shelf 158 is shown. It maybe any one of the shelves hereinbefore described. The shelf has affixed thereto or is unitarily formed to have a tubular extension 160 to extend upwardly therefrom a distance 162 sufficient to provide the shelf 158 with stability. The shelf 158 may otherwise be horizontally unstable and thus be easily tipped. Preferably, but not necessarily, the extension 160 extends upwardly to about but just below the ring 163 associated with the shelf above or to the top of the shaft 150 for the top shelf of a multiple shelf arrangement. The tubular extension 160 is sized to have an inside diameter so the extension fits snuggly but rotatably about the shaft 150. The ring 152 may be made of any suitable material including plastic.

It can be appreciated from the above-described embodiments that earrings, such as those generally referred to as post-type pierced earrings, can be positioned in the mesh portions of the shelves with the shafts of the pierced earrings extending through the apertures in the mesh and with the decorative structure of the earrings being supported by the latticework of the mesh. The fasteners for the post-type pierced earrings can be positioned in the recesses 32 and 34 for easy removal therefrom when desired by the user. Similarly, other articles of jewelry such as chains, necklaces and elongated earrings can be suspended from posts 84 positioned on the top shelf 24 or other upper shelves if the height of the carousel 10 is selected to provide for suspension of elongated articles from more than one shelf. Similarly, elongated slots such as slots 80, 86, 88 can be formed in solid portions of the shelves and even in the mesh portions, if structurally rigid mesh is used, in order to receive rings or other articles of jewelry having extended portions which will fit through selectively sized slots and which can be supported by the edges of the slots or the portion of the surface of the shelf immediately proximate the slot. It can be further seen that the user can organize post-type pierced earrings in pairs conveniently on shelves based on type, shape and color, and in turn avoid the problem of having to sort through a quantity of jewelry in a compartment, tray or bin of a conventional jewelry box.

It may also be understood and appreciated that a variety of different housing structures and shapes may be used other than the round or cylindrical shape structure as herein described and illustrated. Also, the opening or access can be provided by a wide variety of hinged or sliding doors. Further, housing structures with sliding shelves may also be used. However, the cylindrical form and circular shape of the shelves is preferred.

It is to be understood that the embodiments of the invention above described are merely illustrative of the application of the principals of the invention. Reference herein to details of the illustrated embodiments is not intended to limit the scope of the claims which themselves recite those features regarded as essential to the invention.

I claim:

1. A personal article storage apparatus comprising:

a base;

a shaft in mechanical association therewith and extending upwardly from said base;

a shelf mounted to said shaft, said shelf having a mesh as a substantial portion of its surface with said mesh being formed of intersecting lattice members to form a plurality of apertures sized to receive a pin-like post of an article to be stored and to support said article on the lattice members; and a first housing member and a second housing member mechanically associated therewith, said first and second housing members together being sized to surround said shelf, and said first housing member being mounted alternatively and selectively to said base and said second housing member to open to provide access to said shelf, wherein said first and second housing members are each semicircular-like in cross-section to form a truncated cylinder-like structure, and wherein one of said housing members is slidably mounted to said base and sized to snugly and slidably move around the other housing member.

2. The apparatus of claim 1 wherein a plurality of shelves are mounted to said shaft in spaced relation therealong.

3. The apparatus of claim 2 wherein said shelves are sized in surface area and spaced along said shaft so that the fingers of the user can place and remove articles anywhere on the surface of a shelf.

4. The apparatus of claim 3 wherein said shelves are fixedly secured to said shaft and said shaft is rotatably mounted to said base.

5. The apparatus of claim 2 wherein said shelves are rotatably mounted to said shaft.

6. The apparatus of claim 1 wherein said base has formed therein at least one recess to receive articles for storage.

7. The apparatus of claim 6 wherein said recess is formed to be shallow and dish-like.

8. The apparatus of claim 1 wherein said first and second housing members are formed to each have a top surface member.

9. The apparatus of claim 1 wherein a plurality of shelves are mounted to said shaft in spaced relation therealong and each of said shelves rotate about said shaft and wherein one of said shelves is a bottom shelf having said mesh as a substantial portion of its surface, wherein the other shelves are formed to have less surface area than said bottom shelf to provide access to the surface area of said shelves.

10. The apparatus of claim 9 wherein said other shelves are formed to be substantially semicircular in projection with a portion of their perimeters substantially similar in projection and dimension to the perimeter of said bottom shelf.

11. The apparatus of claim 2 wherein one of said shelves is a top shelf which has affixed thereto a plurality of posts in spaced relation about its perimeter for suspending elongated articles therefrom, and wherein said tip shelf has formed therein at least one elongated slot for receiving the base of an article therethrough said supporting said article on said surface.

12. A jewelry storage apparatus comprising:

a base with a top surface;

at least one disk-like recess formed in said base for receiving and storing small objects;

a shaft mounted to said base and extending upwardly therefrom;

a bottom shelf mounted to said shaft spaced above said base top surface to permit finger access to said recess;

a plurality of shelves mounted to said shaft in spaced relation with respect to each other and said bottom shelf; and a housing structure mounted to surround said shelves and operable to provide access to said shelves, wherein said housing structure includes a first housing member and a second housing member each being substantially semicircular-like in cross-section to form a cylinder-like structure, wherein one of said housing members is secured to said base and the other of said housing members is slidably and rotatably positioned on said base to rotate about the effective centerline of said cylinder to provide said access.

13. The apparatus of claim 12 wherein at least one of said shelves has a substantial portion of its surface formed of a mesh with a plurality of apertures formed by lattice members, the apertures being sized to receive the post of a post-type pierced earring and the lattice members supporting the decorative structure of said earring, and wherein said shelves are mounted to be rotatable.

* * * * *